US011852331B1

(12) United States Patent
Bei

(10) Patent No.: US 11,852,331 B1
(45) Date of Patent: Dec. 26, 2023

(54) ALL-INCLUSIVE SILICONE WATERPROOF LIGHTING MECHANISM

(71) Applicant: Liuqing Bei, Jieyang (CN)

(72) Inventor: Liuqing Bei, Jieyang (CN)

( * ) Notice: Subject to any disclaimer, the term of this patent is extended or adjusted under 35 U.S.C. 154(b) by 0 days.

(21) Appl. No.: 18/310,742

(22) Filed: May 2, 2023

(30) Foreign Application Priority Data

Mar. 24, 2023 (CN) ..... 202320598887.3

(51) Int. Cl.
*F21V 31/00* (2006.01)
*F21S 9/02* (2006.01)

(52) U.S. Cl.
CPC ..... *F21V 31/005* (2013.01); *F21S 9/02* (2013.01)

(58) Field of Classification Search
CPC ..... F21V 31/005; F21V 15/01; F21V 15/012; F21V 15/013; F21S 9/02
See application file for complete search history.

(56) References Cited

U.S. PATENT DOCUMENTS 5,054,778 A * 10/1991 Maleyko ..... H05B 45/00 446/485
2007/0291488 A1* 12/2007 Heathcock ..... H05B 47/19 362/276
2014/0036511 A1* 2/2014 Whitfield ..... F21L 14/023 362/311.02
2017/0175997 A1* 6/2017 Rosenblum ..... F21V 23/003
2020/0149695 A1* 5/2020 Jeong ..... F21V 23/02
2020/0248897 A1* 8/2020 Johnson ..... F21S 6/001
2021/0396367 A1* 12/2021 Guedez ..... F21S 10/04

* cited by examiner

*Primary Examiner* — Peggy A Neils
*Assistant Examiner* — James M Endo
(74) *Attorney, Agent, or Firm* — Daniel M. Cohn; Howard M. Cohn

(57) ABSTRACT

An all-inclusive silicone waterproof lighting mechanism includes an all-inclusive silicone wrapping layer, and a lighting assembly. The all-inclusive silicone wrapping layer and the lighting assembly are integrally formed and manufactured. The lighting assembly is arranged in the control mechanism sleeve. A circuit board, a battery, a lighting lamp, and a magnetic charging head are fixedly installed inside the control mechanism sleeve.

5 Claims, 2 Drawing Sheets

ALL-INCLUSIVE SILICONE WATERPROOF LIGHTING MECHANISM

TECHNICAL FIELD

The present disclosure relates to a technical field of all-inclusive silicone lighting, and in particular to an all-inclusive silicone waterproof lighting mechanism.

BACKGROUND

With the rapid development of science and technology, lighting products are widely used, and demands for the lighting products become higher and higher. There are various types of the lighting products on the market, which include household lighting, outdoor lighting, handicraft decorative lighting, and the like.

However, conventional lighting products are generally assembled and sealed by adhesive, and the conventional lighting products have poor waterproof and dustproof effects, resulting in short circuit of the conventional lighting products caused by moisture. When in winter, temperature is low and the adhesive shrinks, so that the adhesive falls off and cracks. When in summer, the temperature is high, and the adhesive expands and loosens. Further, the adhesive is not resistant to aging. Especially, when the conventional lighting products are used in outdoor rainy days, bathrooms, and other scenes, and once water enters the the conventional lighting products, the conventional lighting products short-circuit and stop working. Moreover, a production method of using the adhesive to bond the conventional lighting products, increases labor costs, produces defective products, and causes a large waste of materials during a production process. Therefore, an all-inclusive silicone waterproof lighting mechanism is provided to solve above problems.

SUMMARY

In view of defects in the prior art, the present disclosure provides an all-inclusive silicone waterproof lighting mechanism to solve or partially solve the defects in the prior art.

The present disclosure provides the all-inclusive silicone waterproof lighting mechanism. The all-inclusive silicone waterproof lighting mechanism includes an all-inclusive silicone wrapping layer, a lighting assembly, and a control mechanism sleeve. The lighting assembly includes a circuit board, a lighting lamp, a lighting lamp panel, and a magnetic charging head.

The circuit board is fixedly installed inside the control mechanism sleeve. The circuit board is electrically connected to a battery.

The lighting lamp is electrically connected to the circuit board.

The circuit board, the battery, and the lighting lamp are fixedly installed inside the control mechanism sleeve.

The lighting lamp panel is installed on the lighting lamp.

The magnetic charging head is electrically connected to the circuit board.

In one optional embodiment, the circuit board is connected to the battery through a battery wire.

In one optional embodiment, the circuit board is connected to the lighting lamp through a lighting lamp wire.

In one optional embodiment, the lighting lamp is fixedly installed inside the control mechanism sleeve, and the lighting lamp panel installed on the lighting lamp is exposed outside the control mechanism sleeve.

In one optional embodiment, a first end of the charging wire is connected to the magnetic charging head, and a second end of the charging wire is electrically connected to the circuit board.

In one optional embodiment, a first end of the magnetic charging head is fixedly installed inside the control mechanism sleeve, and a second end of the magnetic charging head passes through the all-inclusive silicone wrapping layer, and the second end of the magnetic charging head is exposed outside the all-inclusive silicone wrapping layer.

The all-inclusive silicone waterproof lighting mechanism of the present disclosure has following characteristics:

1. The all-inclusive silicone wrapping layer and the lighting assembly are integrally formed and manufactured, so that the all-inclusive silicone waterproof lighting mechanism is fully sealed and has good waterproof and dust-proof effects.

2. The all-inclusive silicone wrapping layer is transparent, so that the all-inclusive silicone waterproof lighting mechanism has a good lighting effect. The all-inclusive silicone wrapping layer is made of silicone and is elastic, so that the all-inclusive silicone waterproof lighting mechanism is prevented from being damaged due to collision and deformation.

3. During a manufacturing process of the all-inclusive silicone waterproof lighting mechanism, manual adhesive assembly operation is not needed, which solves a problem of adhesive aging, and makes the all-inclusive silicone waterproof lighting mechanism safer and environmentally friendly, improves the production efficiency, and reduces a reject ratio thereof, and saves costs of labor and materials.

BRIEF DESCRIPTION OF DRAWINGS

In order to clearly illustrate technical solutions of the present disclosure, the present disclosure will be described in detail below with reference to the accompanying drawings. It should be noted that, the accompanying drawings only show some embodiments of the present disclosure described below, and should not be construed as being limited to protection scope of the present disclosure set forth herein. For the person of ordinary skill in the art, other related drawings can be obtained according to the accompanying drawings without any creative effort.

Figure 1:
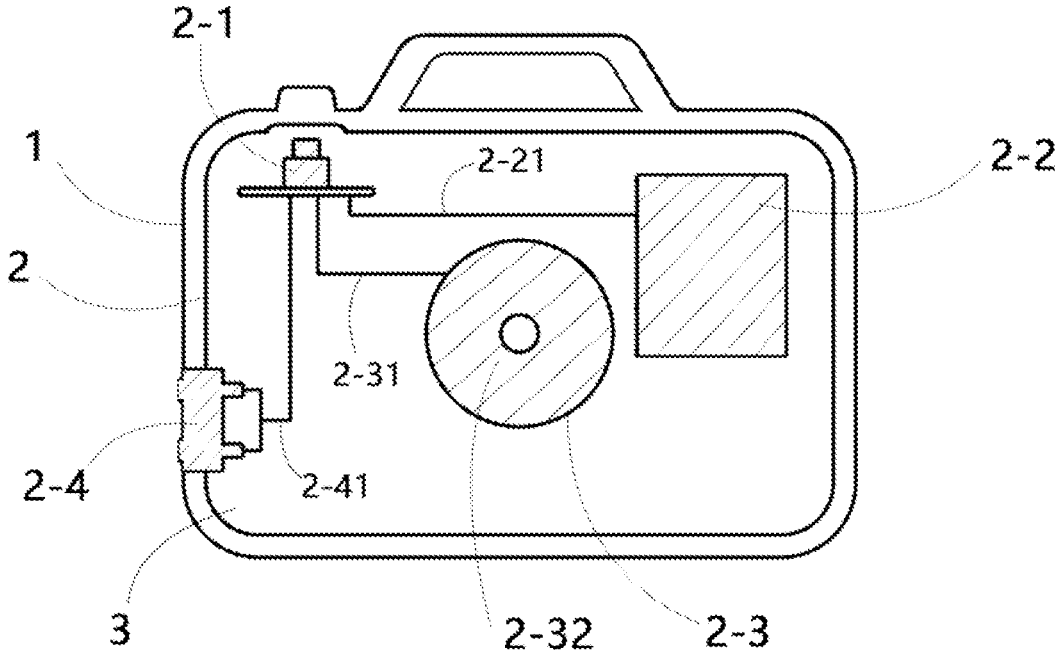
FIG. 1 is a front cross-sectional structural schematic diagram of the present disclosure.

Reference numbers in the drawings: all-inclusive silicone wrapping layer 1; lighting assembly 2; control mechanism sleeve 3; circuit board 2-1; battery wire 2-21; battery 2-2; lighting lamp 2-3; lighting lamp wire 2-31; lighting lamp panel 2-32; charging wire 2-41; magnetic charging head. 2-4.

DETAILED DESCRIPTION OF EMBODIMENTS

In order to clearly illustrate purposes, technical solutions, and advantages of the implementation method of the present disclosure, the present disclosure will be clearly described in detail below with reference to the accompanying drawings.

Figure 2:
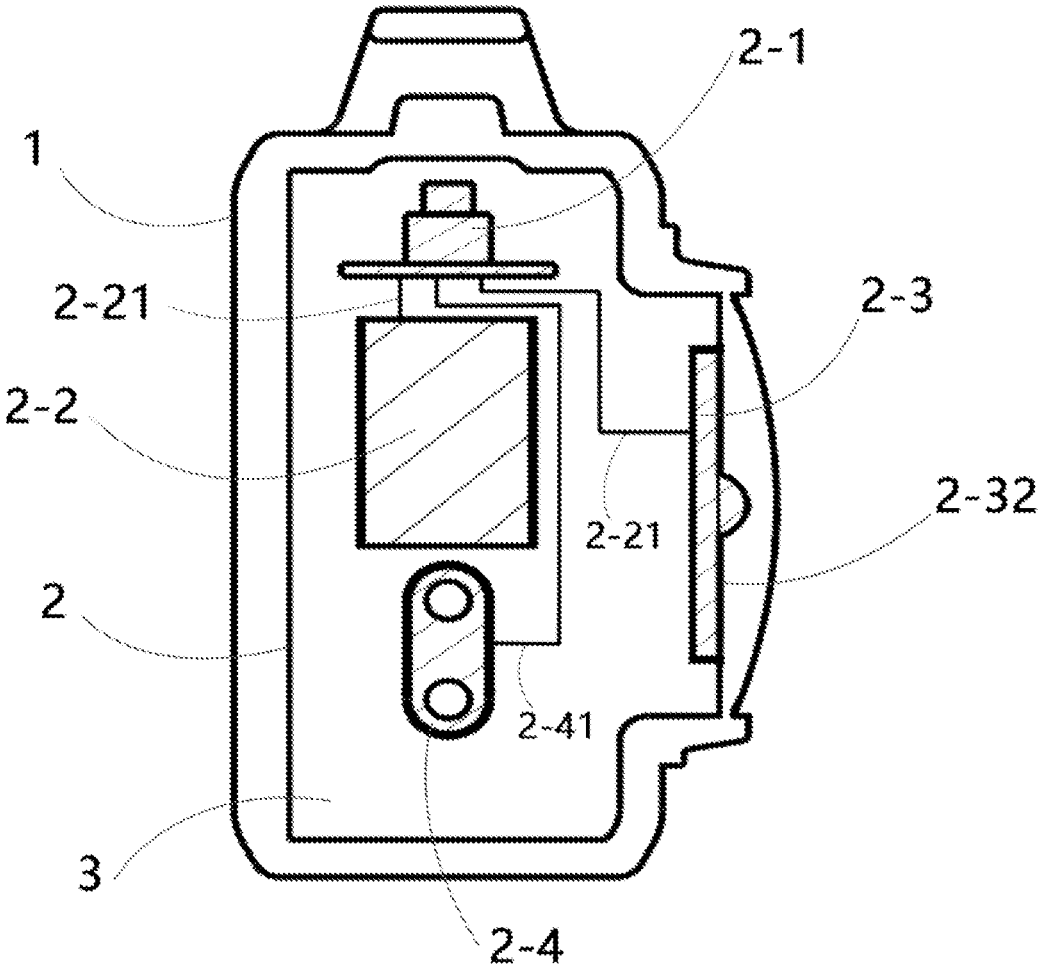
FIG. 2 is a side cross-sectional structural schematic diagram of the present disclosure.

As shown in FIGS. 1-2, the present disclosure provides an all-inclusive silicone waterproof lighting mechanism including an all-inclusive silicone wrapping layer 1, a lighting assembly 2, and a control mechanism sleeve 3.

The lighting assembly 2 is arranged in the control mechanism sleeve 3. The lighting assembly 2 includes a circuit board 2-1, a lighting lamp 2-3, a lighting lamp panel 2-32, and a magnetic charging head 2-4.

The circuit board 2-1 is fixedly installed inside the control mechanism sleeve 3. The circuit board 2-1 is connected to the battery 2-2 through a battery wire 2-21. The circuit board 2-1, and the battery 2-2 are fixedly installed inside the control mechanism sleeve 3.

The circuit board 2-1 is connected to the lighting lamp 2-3 through a lighting lamp wire 2-31. The lighting lamp 2-3 is fixedly installed inside the control mechanism sleeve 3. The lighting lamp panel 2-32 installed on the lighting lamp 2-3 is exposed outside the control mechanism sleeve 3, which prevents light emitted by the all-inclusive silicone waterproof lighting mechanism from being blocked by the control mechanism sleeve 3.

The circuit board 2-1 is connected to the magnetic charging head 2-4 through a charging wire 2-41. A first end of the magnetic charging head 2-4 is fixedly installed inside the control mechanism sleeve 3. A second end of the magnetic charging head 2-4 passes through the all-inclusive silicone wrapping layer 1, and the second end of the magnetic charging head 2-4 is exposed outside the all-inclusive silicone wrapping layer 1. It should be noted that, the magnetic charging head 2-4 is made of a magnetic material, and when the all-inclusive silicone waterproof lighting mechanism is charged, the magnetic charging head 2-4 is magnetically connected to an external wire, which facilitates charging of the all-inclusive silicone waterproof lighting mechanism. Additionally, the magnetic charging head 2-4 and the all-inclusive silicone wrapping layer 1 are sealed together. In actual production process, a sealing ring is arranged between the magnetic charging head 2-4 and the all-inclusive silicone wrapping layer 1 for sealing, greatly improving waterproof and sealing effects of the all-inclusive silicone waterproof lighting mechanism.

In one optional embodiment, a first end of the battery wire 2-21 is connected to the circuit board 2-1, and a second end of the battery wire 2-21 is connected to the battery 2-2. The circuit board 2-1 is connected to the battery 2-2 through a battery wire 2-21. The battery 2-2 provides electric energy to the circuit board 2-1, so that the circuit board 2-1 controls the lighting lamp 2-3 to work.

In one optional embodiment, a first end of a charging wire 2-41 is connected to the magnetic charging head 2-4, and a second end of the charging wire 2-41 is electrically connected to the circuit board 2-1. The circuit board 2-1 is connected to the magnetic charging head 2-4 through the charging wire 2-41. The first end of the magnetic charging head 2-4 is fixedly installed inside the control mechanism sleeve 3. The second end of the magnetic charging head 2-4 passes through the all-inclusive silicone wrapping layer 1, and the second end of the magnetic charging head 2-4 is exposed outside the all-inclusive silicone wrapping layer 1. The second end of the magnetic charging head 2-4 is a charging input end of the lighting assembly 2.

In one optional embodiment, the lighting lamp 2-3 is fixedly installed inside the control mechanism sleeve 3. The lighting lamp panel 2-32 installed on the lighting lamp 2-3 is exposed outside the control mechanism sleeve 3. The all-inclusive silicone wrapping layer is transparent, so that the all-inclusive silicone waterproof lighting mechanism has good lighting effect to meet lighting requirements of users.

Specifically, a working process or a working principle of the all-inclusive silicone waterproof lighting mechanism is as follows:

Conventional lighting products have poor waterproof and dustproof effects. Especially, when the conventional lighting products are used in outdoor rainy days, bathrooms, and other scenes, since gaps are formed at assembly joint of the conventional lighting products, the conventional lighting products have poor waterproof and dustproof effects and are easily damaged caused by moisture.

Conventional lighting products use adhesive to bond the gaps formed at assembly joint of the conventional lighting products during production. However, when in winter, temperature is low and the adhesive shrinks, so that the adhesive falls off and cracks. When in summer, the temperature is high, and the adhesive expands and loosens. Further, the adhesive is not resistant to aging. Moreover, a production method of using adhesive to bond the gaps formed at assembly joint of the conventional lighting products increases labor costs, produces defective products, and causes a large waste of materials during a production process. Therefore, the all-inclusive silicone waterproof lighting mechanism is provided to solve above problems.

Specifically, the circuit board 2-1 connected with a wire is powered on by pressing a switch button disposed on the all-inclusive silicone wrapping layer 1.

The circuit board 2-1 controls the lighting lamp 2-3 to work by pressing a control switch.

Light emitted by the lighting lamp 2-3 passes through the all-inclusive silicone wrapping layer 1, so as to realize a Lighting function of the all-inclusive silicone waterproof lighting mechanism. The all-inclusive silicone wrapping layer is transparent, so that the all-inclusive silicone waterproof lighting mechanism has a good lighting effect.

The all-inclusive silicone waterproof lighting mechanism is portable. Because the battery 2-2 providing the electric energy is fixedly installed inside the all-inclusive silicone waterproof lighting mechanism, so that the all-inclusive silicone waterproof lighting mechanism can be carried anywhere for use. When a battery level of the battery 2-2 is low, the battery 2-2 is charged by the magnetic charging head 2-4, so that the lighting lamp 2-3 works normally.

The all-inclusive silicone waterproof lighting mechanism of the present disclosure with a specific shape is integrally formed and manufactured by an all-inclusive silicone forming technology, so that the all-inclusive silicone waterproof lighting mechanism is fully sealed and has good waterproof and dust-proof effects. The all-inclusive silicone wrapping layer is made of silicone and is elastic, so that the all-inclusive silicone waterproof lighting mechanism is prevented from being damaged due to collision and deformation. During a manufacturing process of the all-inclusive silicone waterproof lighting mechanism, manual adhesive assembly operation is not needed, which solves a problem of adhesive aging, makes the all-inclusive silicone waterproof lighting mechanism safer and environmentally friendly, improves the production efficiency, reduces a reject ratio thereof, and saves costs of labor and materials.

It should be noted that, the battery 2-2, the lighting lamp 2-3, and the magnetic charging head 2-4 are conventional devices or apparatuses in the prior art, or are devices or apparatuses can be implemented in the prior art, and power supply, specific composition and principle thereof are clear to the person of ordinary skill in the art, and details of which are not described herein.

The detailed description of the present disclosure is described above in combination with specific preferred embodiments, which should not be regarded as limiting the protection scope of the present disclosure. It should be noted that, for the person of ordinary skill in the art, improvements are made without departing from concepts of the present disclosure, but these are all within the protection scope of the present disclosure.

What is claimed is:

1. A all-inclusive silicone waterproof lighting mechanism, comprising:

an all-inclusive silicone wrapping layer (1);

a lighting assembly (2); and a control mechanism sleeve (3);

wherein the lighting assembly (2) comprises a circuit board (2-1), a lighting lamp frame (2-3), a lighting lamp panel (2-32), and a magnetic charging head (2-4);

wherein the circuit board (2-1) is fixedly installed inside the control mechanism sleeve (3); the circuit board (2-1) is electrically connected to a battery (2-2);

wherein the lighting lamp frame (2-3) is electrically connected to the circuit board (2-1);

wherein the circuit board (2-1), the battery (2-2), and the lighting lamp frame (2-3) are fixedly installed inside the control mechanism sleeve (3);

wherein the lighting lamp panel (2-32) is installed on the lighting lamp (2-3); and wherein the magnetic charging head (2-4) is electrically connected to the circuit board (2-1);

wherein the lighting lamp frame (2-3) is fixedly installed inside the control mechanism sleeve (3); the lighting lamp panel (2-32) installed on the lighting lamp frame (2-3) is exposed outside the control mechanism sleeve (3), and wherein the all-inclusive silicone wrapping layer and the lighting assembly are integrally formed.

2. The all-inclusive silicone waterproof lighting mechanism according to claim 1, wherein the circuit board (2-1) is connected to the battery (2-2) through a battery wire (2-21).

3. The all-inclusive silicone waterproof lighting mechanism according to claim 1, wherein the circuit board (2-1) is connected to the lighting lamp frame (2-3) through a lighting lamp wire (2-31).

4. The all-inclusive silicone waterproof lighting mechanism according to claim 1, wherein a first end of a charging wire (2-41) is connected to the magnetic charging head (2-4), and a second end of the charging wire (2-41) is electrically connected to the circuit board (2-1).

5. The all-inclusive silicone waterproof lighting mechanism according to claim 4, wherein a first end of the magnetic charging head (2-4) is fixedly installed inside the control mechanism sleeve (3); a second end of the magnetic charging head (2-4) passes through the all-inclusive silicone wrapping layer (1), and the second end of the magnetic charging head (2-4) is exposed outside the all-inclusive silicone wrapping layer (1).

* * * * *